US006543089B2

(12) United States Patent
Tasman

(10) Patent No.: US 6,543,089 B2
(45) Date of Patent: Apr. 8, 2003

(54) DOOR HANDLE ASSEMBLY AND DOOR ASSEMBLY INCLUDING THE SAME

(76) Inventor: Randy Tasman, 10 Lake Rd., Huntington, NY (US) 11746

( * ) Notice: Subject to any disclaimer, the term of this patent is extended or adjusted under 35 U.S.C. 154(b) by 58 days.

(21) Appl. No.: 09/745,648

(22) Filed: Dec. 22, 2000

(65) Prior Publication Data

US 2002/0078530 A1 Jun. 27, 2002

(51) Int. Cl.[7] ..... E05F 1/00
(52) U.S. Cl. ..... 16/412; 16/413
(58) Field of Search ..... 16/412, 436, DIG. 41, 16/413, 402; 292/DIG. 53, DIG. 63; 4/596, 599, 600, 670

(56) References Cited

U.S. PATENT DOCUMENTS 1,145,471 A * 7/1915 Dobrick ..... 16/436
2,589,516 A * 3/1952 Stelzer ..... 16/402
3,222,732 A * 12/1965 Miller ..... 16/402
4,161,747 A * 7/1979 Jennings ..... 165/185
5,000,222 A * 3/1991 Moenkhaus et al. ..... 137/15.18

FOREIGN PATENT DOCUMENTS

JP 404250280 A * 9/1992

* cited by examiner

*Primary Examiner*—Anthony Knight
*Assistant Examiner*—Doug Hutton
(74) *Attorney, Agent, or Firm*—Kenyon & Kenyon

(57) ABSTRACT

A door handle assembly includes a first handle and a second handle. First posts are rotatably secured to the handles, and second posts are non-rotatably secured to the handles. A threaded rod is threadably engageable with internally threaded bores formed in each first post and second post. A door panel includes bores for receiving the threaded rods so that the first handle and second handle are secured to opposite sides of the door panel when the first and second posts are engaged with the threaded rods. A door assembly includes the aforementioned door handle assembly.

29 Claims, 6 Drawing Sheets

DOOR HANDLE ASSEMBLY AND DOOR ASSEMBLY INCLUDING THE SAME

FIELD OF THE INVENTION

The present invention relates to a door handle assembly and a door assembly including the door handle assembly. More particularly, the present invention relates to a door handle assembly for a glass door, such as, for example, a shower door and a door assembly including the same.

BACKGROUND INFORMATION

Numerous types of door handle designs and configurations are known in the art. There are several disadvantages to such designs. First, conventional door handle assemblies require the use of tools for installation. Tools may also be required for removal of the installed door handle assembly for maintenance and/or service. In addition, small set screws are generally employed in installing such conventional door handle assemblies. These small set screws can be lost before assembly or upon disassembly. Furthermore, if these set screws are exposed to the environment, rust or other corrosion can occur, thereby weakening the entire door handle assembly and compromising the integrity thereof. This is particularly disadvantageous where the door handle assembly is used in conjunction with a shower door or other door exposed to water and/or other contaminants.

It is therefore an object of the present invention to provide a door handle assembly that can be installed and removed without the use of tools.

It is a further object of the present invention to provide a door handle assembly that does not require the use of fastening hardware to install the door handle assembly.

It is yet another object of the present invention to provide a door handle assembly having no exposed fastening hardware.

It is still another object of the present invention to provide a door handle assembly having a first handle, a second handle, first posts rotatably secured to the handles, second posts non-rotatably secured to the handles and threaded rods engageable with the first and second posts and receivable in bores of a door panel so that the first and second handles are securable to the door panel on opposite sides thereof.

Finally, it is an object of the present invention to provide a door assembly that includes the aforementioned door handle assembly.

SUMMARY

The above and other beneficial objects of the present invention are most effectively attained by providing a door handle assembly and a door assembly as described and claimed herein. In one embodiment, the door handle assembly includes first and second handles securable to opposite sides of a door. First posts are rotatably secured to the handles, and second posts are non-rotatably secured to the handles. A threaded rod is provided for each respective pair of first and second posts and is receivable in a bore formed in the door panel. Each of the first and second posts is internally threaded for threadably engaging the threaded rod to secure the door handle assembly to the door. A door assembly includes the aforementioned door handle assembly.

DETAILED DESCRIPTION

Figure 1:
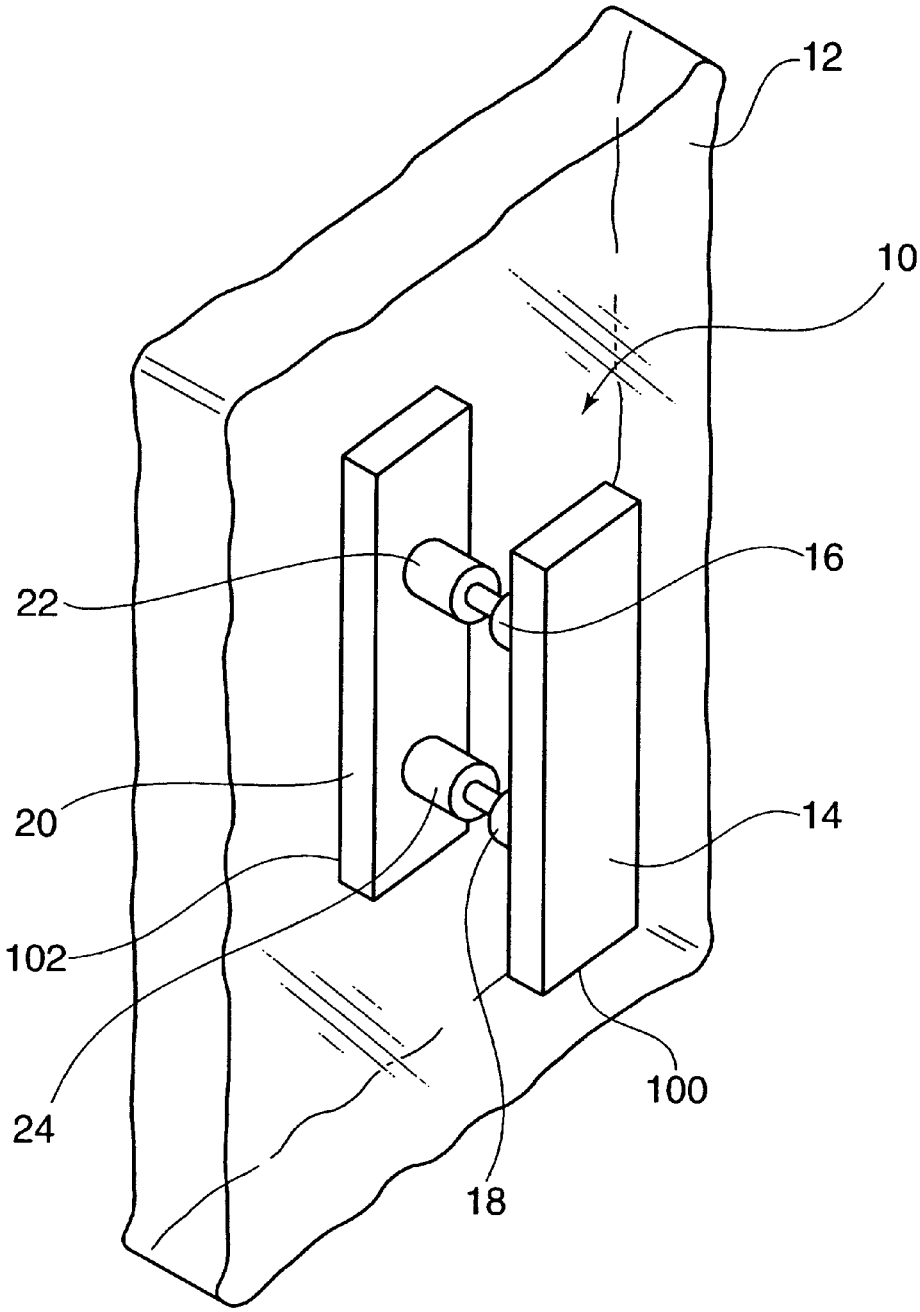
FIG. 1 is a perspective view of a door handle assembly according to the present invention.

Those skilled in the art will gain an appreciation of the present invention from a reading of the following description when viewed in conjunction with the accompanying drawings of FIGS. 1–6, inclusive. The individual reference characters designate the same or similar elements throughout the several views.

Referring to FIG. 1, there is seen a perspective view of a door handle assembly 10 according to the present invention. Door handle assembly 10 is seen in FIG. 1 assembled with a door 12. The door may be, for example, a glass door, such as a shower door. It should be appreciated, however, that the door handle assembly 10 may be assembled and used in conjunction with any type of door 12.

Door handle assembly 10 includes a first handle section 100 and a second handle section 102. First handle section 100 includes a first handle 14 and two posts 16, 18, each extending from first handle 14. Similarly, second handle section 102 includes a second handle 20 and two posts 22, 24, each extending from second handle 20. It should be understood that door handle assembly 10 may include any number of posts and that the present invention is in no way limited to the two posts as described in the exemplary embodiment. Each of the posts 16,18, 22, 24 is preferably substantially cylindrical.

Figure 2:
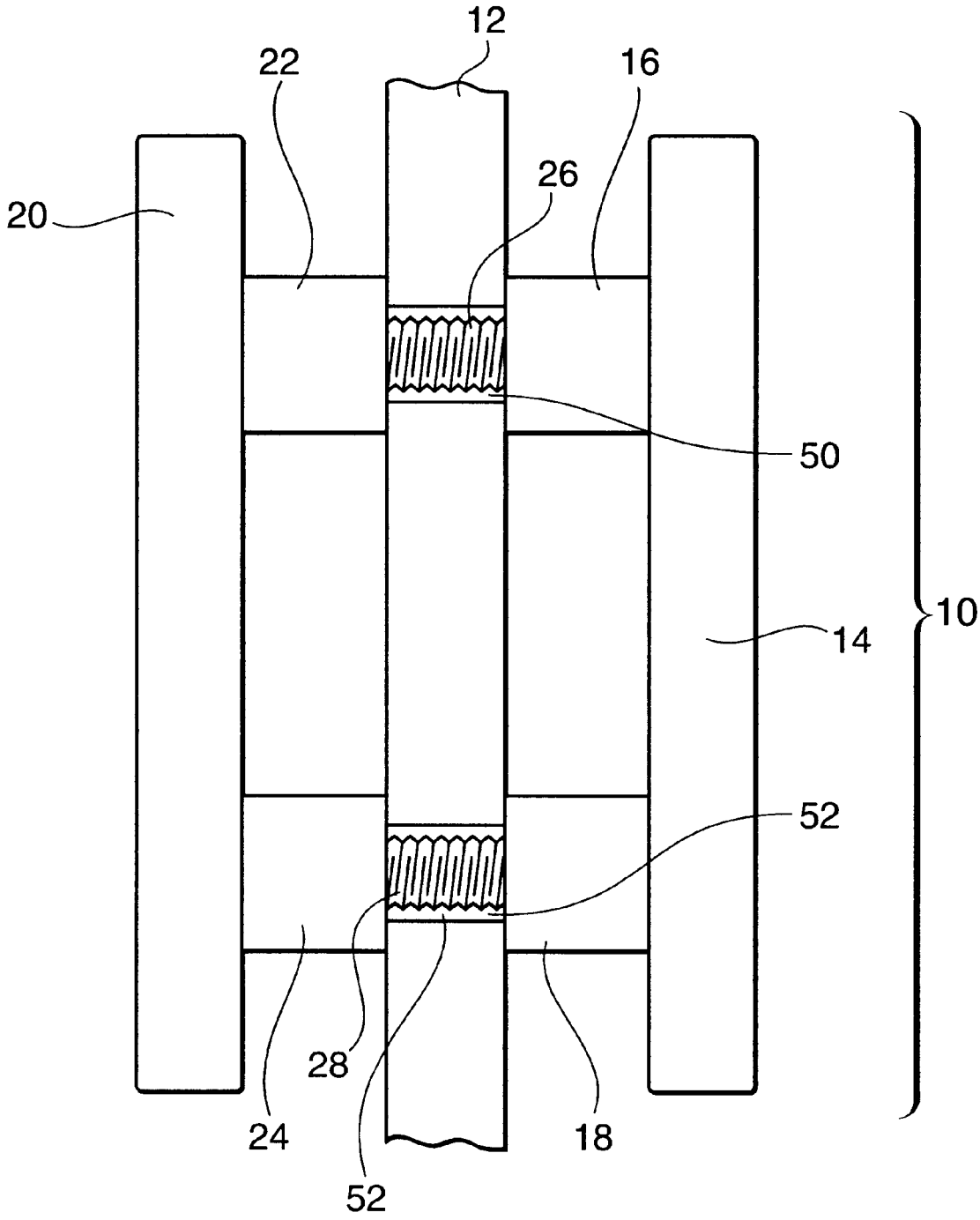
FIG. 2 is a side elevational view of the door handle assembly illustrated in FIG. 1.
Figure 3:
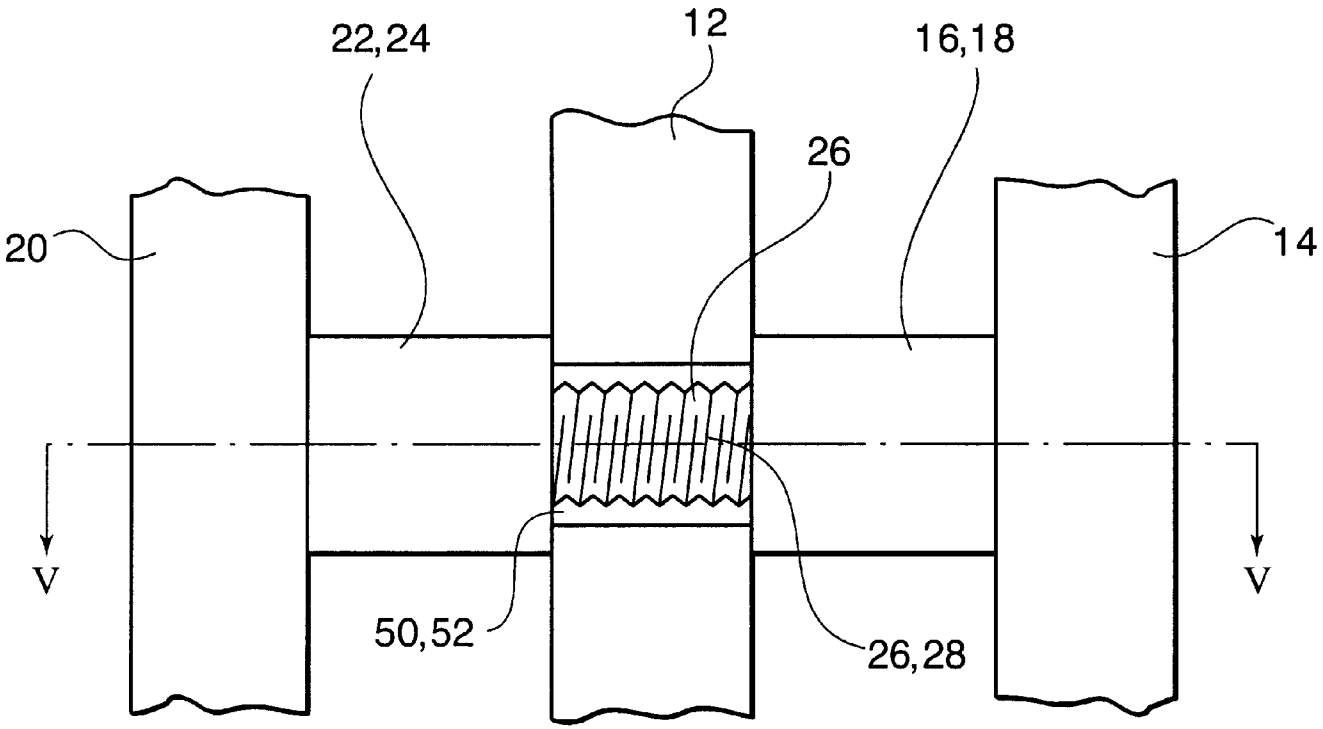
FIG. 3 is a top plan view of the door handle assembly illustrated in FIGS. 1 and 2.

Referring now to FIG. 2, there is seen a side elevational view of the door handle assembly 10. As seen in FIG. 2, first handle 14 and second handle 20 are arranged substantially in parallel to the door 12 on opposite sides thereof and opposing each other. Bores 50, 52 are formed in door 12 for receiving threaded rods 26, 28, as more fully described below. FIG. 3 illustrates a top plan view of the door handle assembly 10.

Figure 4:
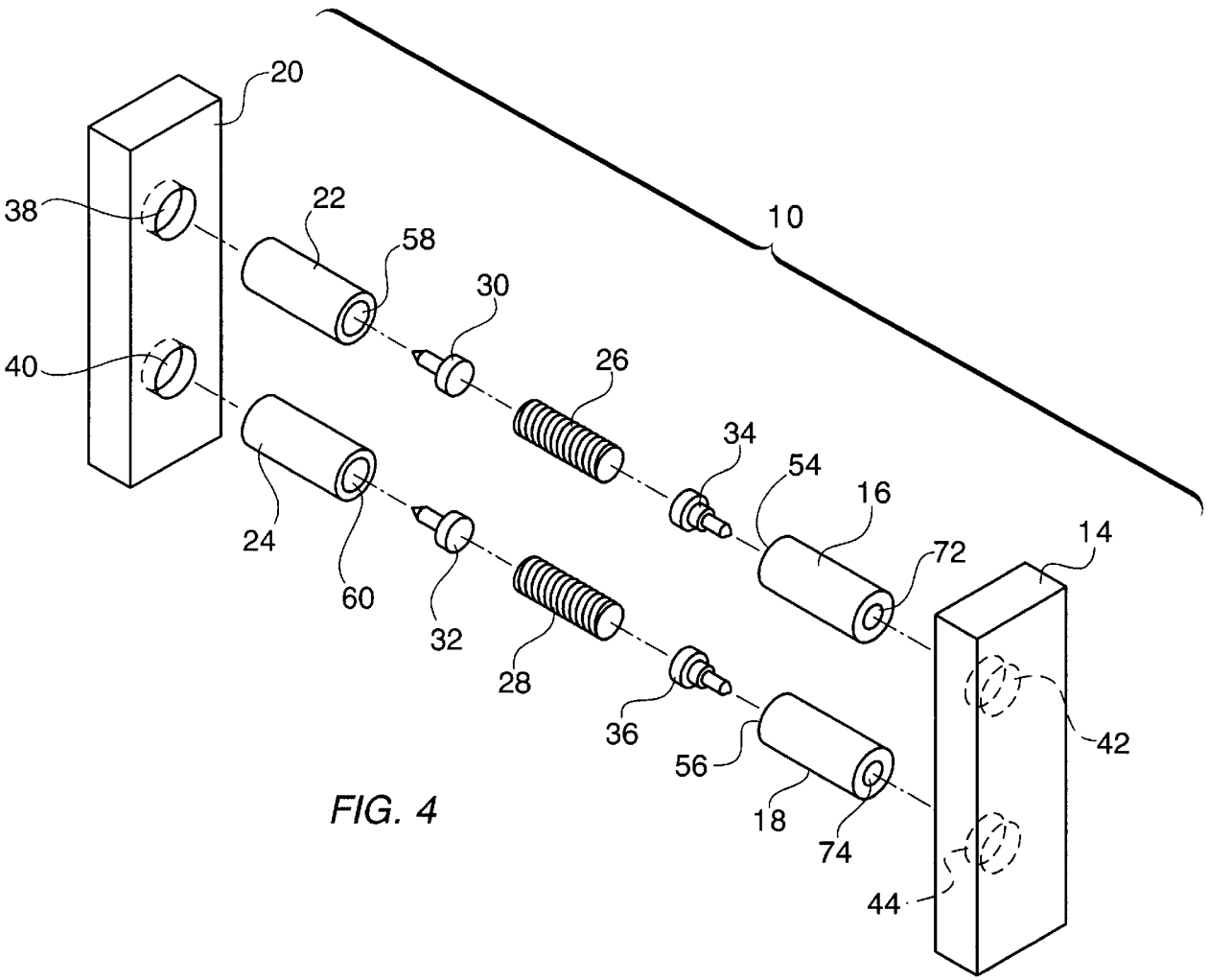
FIG. 4 is an exploded view of the door handle assembly illustrated in FIGS. 1–3.

Referring now to FIG. 4, there is seen an exploded view of the door handle assembly 10. For clarity, the door 12 is not shown in FIG. 4. First handle 12 includes a channel 42 adapted by size and configuration to receive post 16 and a channel 44 adapted by size and configuration to receive post 18. Similarly, second handle 20 includes a channel 38 adapted by size and configuration to receive post 22 and a channel 40 adapted by size and configuration to receive post 24. In the preferred cylindrical configuration of the posts 16, 18, 22, 24, the channels 38,40, 42, 44 are configured as cylindrical bores have a slightly larger diameter than the diameter of posts 16, 18, 22, 24. A set screw 30 is provided for securing post 22 in channel 38, and a set screw 32 is provided for securing post 24 in channel 40.

Figure 5:
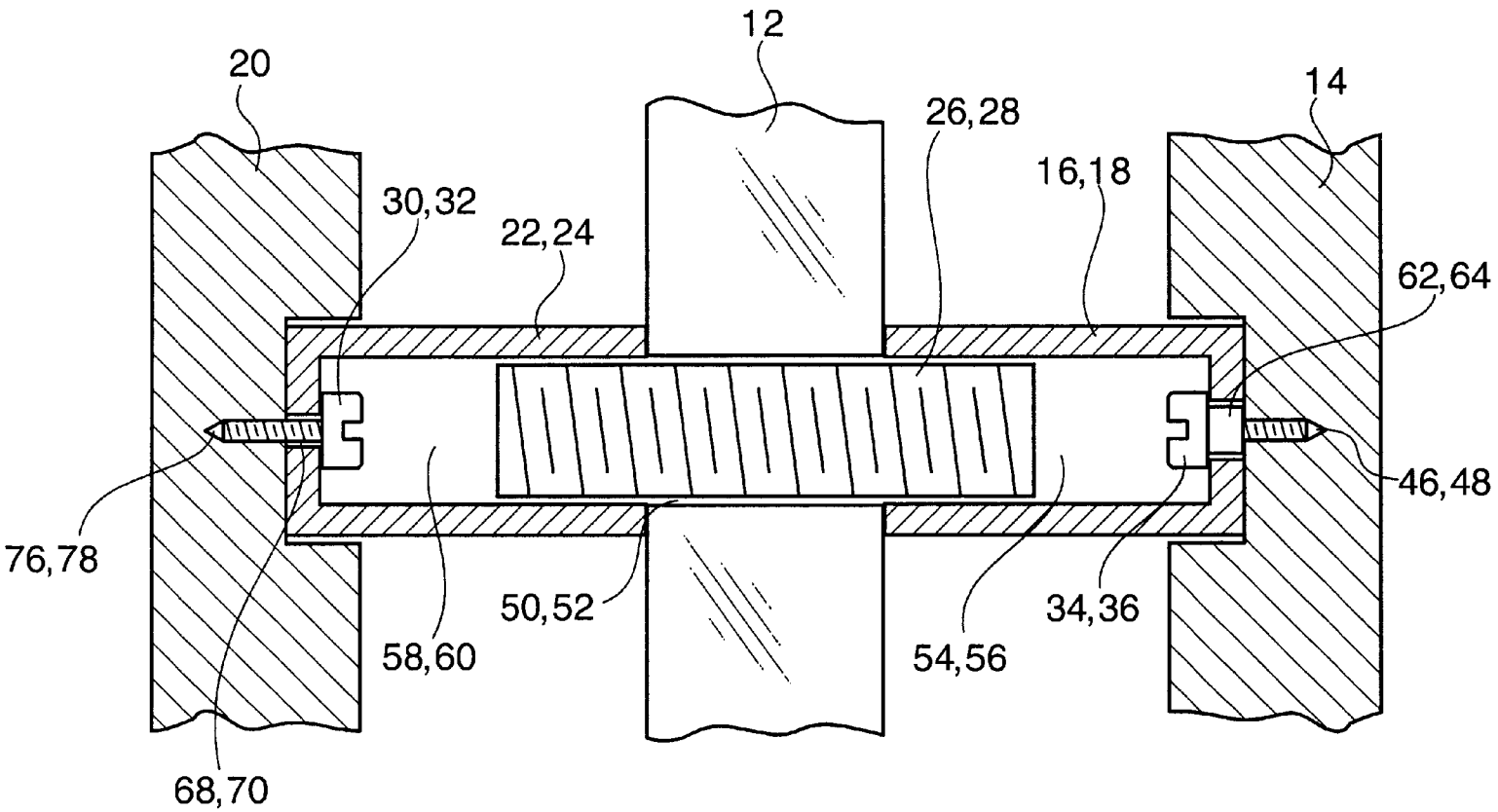
FIG. 5 is a sectional view of the door handle assembly illustrated in FIGS. 1–4 taken along the line 5—5 shown in FIG. 3.

Preferably, the set screw 30 secures post 22 in channel 38 so that post 22 cannot rotate relative to second handle 20, and the set screw 32 secures post 24 in channel 40 so that post 24 cannot rotate relative to second handle 20. Keying structures may also be provided on the posts 22, 24 and/or channels 38, 40 to maintain the posts 22, 24 in a non-rotational relationship to second handle 20. Each of the posts 22, 24 includes a respective internally threaded bore 58, 60. An externally threaded rod 26 is threadably engageable with the internally threaded bore 58, and an externally threaded rod 28 is threadably engageable with the internally threaded bore 60. Each of the externally threaded rods 26, 28 is preferably formed of a plastic or other resilient material, such as nylon, particularly when the door handle assembly 10 is intended for use in conjunction with a glass door 12 to avoid, or at least minimize, the possibility of chipping, cracking or otherwise damaging the glass door 12. Referring to FIG. 5, which is a sectional view of the door handle assembly 10 taken along the line 5—5 as shown in FIG. 3, it can be seen that each of the posts 22, 24 includes a respective bore 68, 70 for receiving respective set screw 30, 32 therethrough and that second handle 20 includes internally threaded bores 76, 78 for threadably receiving the respective set screw 30, 32 therein.

Referring again to FIG. 4, it can be seen that post 16 includes an internally threaded bore 54 for threadably engaging the externally threaded rod 26 and that post 18 includes an internally threaded bore 56 for threadably engaging the externally threaded rod 28. A set screw 34 is provided for securing post 16 in channel 42, and a set screw 36 is provided for securing post 18 in channel 44. Post 16 includes a bore 72 for receiving set screw 34 therethrough, and post 18 includes a bore 74 for receiving set screw 36 therethrough. Unlike the configuration of posts 22, 24 and channels 38, 40, posts 16, 18, channels 42, 44 and set screws 34, 36 are configured so that the posts 16,18 are rotatably secured to the first handle 14.

Figure 6:
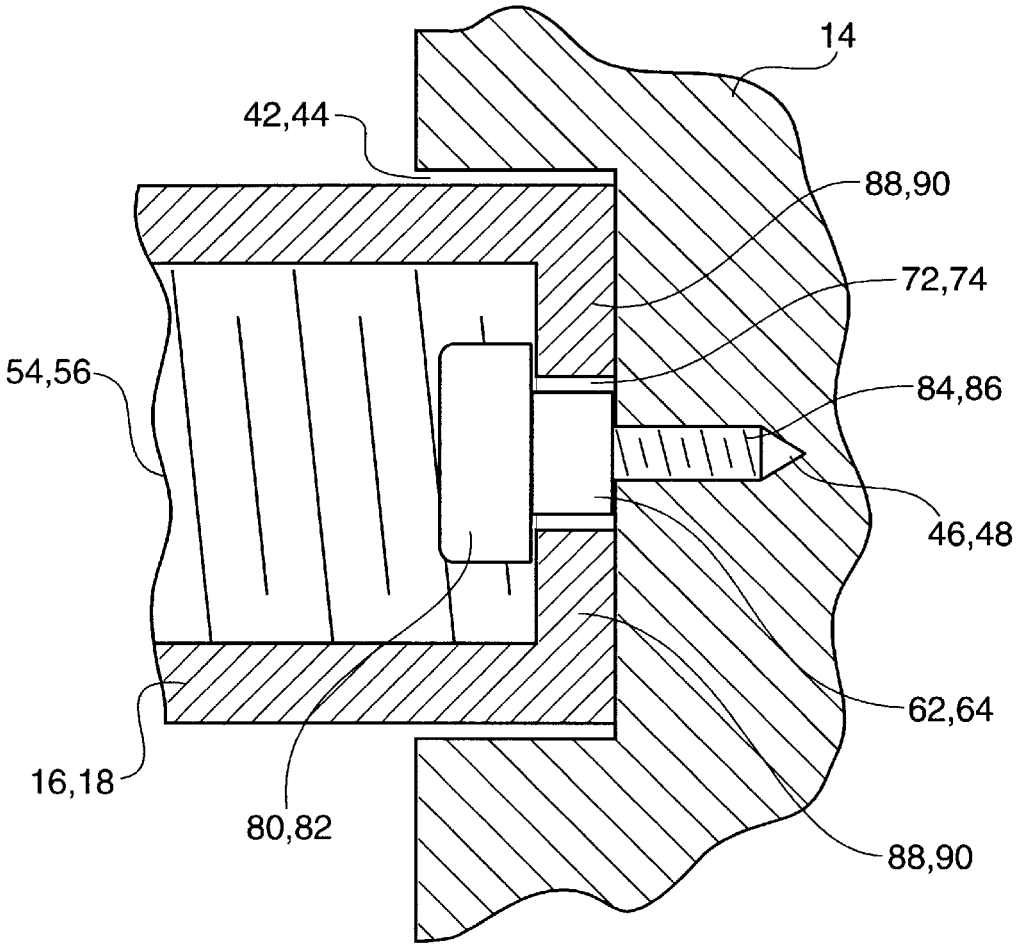
FIG. 6 is a sectional view of a post arrangement of the door handle assembly illustrated in FIGS. 1–5.

Referring now to FIG. 6 there is seen an enlarged sectional view illustrating the arrangement that permits the posts 16, 18 to rotate relative to the first handle 14 while the posts 16, 18 are secured thereto. Each of the set screws 34, 36 includes a respective head portion 80, 82, a respective externally threaded portion 84, 86 and a respective step portion 62, 64. The step portion 62, 64 has a smaller diameter than the head portion 80, 82 but a larger diameter than the externally threaded portion 84, 86. However, the diameter of the step portion 62, 64 is smaller than the diameter of the bore 72, 74, and the height of the step portion 62, 64 is larger than the thickness of flange portion 88, 90 of post 16,18, respectively. The externally threaded portion 84, 86 of set screws 34, 36 are threadably engageable with the internally threaded bores 46, 48 of first handle 14. When the set screws 34, 36 are fully engaged with the respective internally threaded bore 46, 48, the step portion 62, 64 abuts the surface of the blind end of channel 42, 44 . The dimensions of the step portions 62, 64, bores 72, 74 and flanges 88, 90, as well as the diameters of the posts 16, 18 and channels 42, 44, are preferably selected so that posts 16,18 can freely rotate about the respective set screw 34, 36 but that movement of the posts 16, 18 with respect to the first handle 14 is substantially limited to rotational movement. That is, lateral movement of the posts 16, 18 with respect to the handle 14 is substantially restricted. As an alternative to stepped set screws 34, 36, a spacer or stand-off 62, 64 may be provided on the externally threaded portions 84, 86 so that the posts 16, 18 are rotatably secured to the first handle 14.

The door handle assembly 10 may be assembled with door 12 and secured thereto as follows. With posts 22, 24 non-rotatably secured to second handle 20 through set screws 30, 32, the externally threaded rods 26, 28 are initially engaged with the respective post 22, 24. The externally threaded rods 26, 28 may be secured in the respective internally threaded bore 58, 60 by an adhesive or other bonding agent. The externally threaded rods 26, 28 are inserted through the respective bores 50, 52 formed in door 12. The internally threaded bores 54, 56 of posts 16, 18 are aligned with the respective externally threaded rod 26, 28, and the posts 16, 18 are rotated to engage the posts 16, 18 to the respective externally threaded rod 26, 28. Each post 16, 18 is further rotated so that the door 12 is tightly engaged between the opposing posts 16, 22 and 18, 24. Thus, the door handle assembly 10 is secured to the door 12 without the need for any installation tools and without the need for any additional set screws, which might tend to loosen, rust or otherwise corrode over time. Additionally, all of the hardware securing the door handle assembly 10 to the door 12 is contained within the components of the door handle assembly 10. That is, the door handle assembly 10, as installed, includes no exposed or visible hardware. Thus, the door handle assembly 10 according to the present invention provides for not only a clean appearance but also limits environmental exposure of the hardware components. This is particularly advantageous when the door handle assembly 10 is used in conjunction with a shower door 12. When used in conjunction with a shower door 12, exposure of the hardware components, particularly the set screws 30, 32, 34, 36, to water and other contaminants is reduced or eliminated. Sealing components may be provided to further limit exposure of the components of door handle assembly 10 to contaminants.

It should be appreciated that although the non-rotatable posts 22, 24 are described above as being provided on the second handle 20 and the rotatable posts 16, 18 are described above as being provided on the first handle 12, the posts 16, 18, 22, 24 may be rotatable or non-rotatable in any combination. For example, posts 16 and 24 may be rotatable, and corresponding posts 22, 18 may be non-rotatable.

Thus, the several aforementioned objects and advantages of the present invention are most effectively attained. Those skilled in the art will appreciate that many modifications of the preferred embodiment described herein above may be made without departing from the spirit and scope of the invention. For example, bushings formed of plastic, rubber, nylon or other pliable material may be provided between the posts 16, 18, 22, 24 and the door 12 to provide a water-tight seal therebetween and to reduce the possibility of chipping, breaking or otherwise damaging the door 12. Although a single preferred embodiment of the invention has been described and disclosed in detail herein, it should be understood that this invention is in no sense limited thereby and that its scope is to be determined by that of the appended claims.

What is claimed is:

1. A door handle assembly, comprising:

a first handle;

a second handle;

at least one first post, each of the at least one first posts including a first internally threaded bore;

at least one second post, each of the at least one second posts corresponding to a respective one of the at least one first posts, each of the at least one second posts including a second internally threaded bore;

at least one externally threaded rod, each of the at least one externally threaded rods corresponding to and threadably engageable with a respective one of the at least one first posts and a respective one of the at least one second posts;

wherein for each corresponding pair of first posts and second posts, the first post is secured to one of the first handle and the second handle and rotatable relative to the one of the first handle and the second handle, and the second post is secured to the other one of the first handle and the second handle and non-rotatable relative to the other one of the first handle and the second handle.

2. The door handle assembly according to claim 1, wherein each of the at least one first posts is substantially cylindrical.

3. The door handle assembly according to claim 1, wherein each of the at least one second posts is substantially cylindrical.

4. The door handle assembly according to claim 1, wherein the first handle includes at least one first channel for receiving a respective one of the posts.

5. The door handle assembly according to claim 1, wherein the second handle includes at least one second channel for receiving a respective one of the posts.

6. The door handle assembly according to claim 1, wherein the threaded rod is formed of a resilient material.

7. The door handle assembly according to claim 1, wherein the threaded rod is formed of nylon.

8. The door handle assembly according to claim 1, further comprising at least one bushing abutting at least one of the first posts and the second posts.

9. The door handle assembly according to claim 1, wherein each of the at least one second posts is secured to the respective handle by a set screw.

10. The door handle assembly according to claim 1, wherein each of the at least one first posts is secured to the respective handle by a set screw.

11. The door handle assembly according to claim 10, wherein the set screw includes a head portion and step portion, the step portion having a diameter less than a diameter of the head portion and having a height, each of the at least one first posts having a flange portion, the flange portion having a thickness less than the height of the step portion and having a bore for receiving the set screw therethrough, the bore having a diameter greater than the diameter of the step portion and less than the diameter of the head portion.

12. The door handle assembly according to claim 11, wherein the step portion is defined by a spacer.

13. The door handle assembly according to claim 1, wherein a bonding agent is provided for maintaining the threaded engagement of each threaded rod and the respective one of the at least one first posts.

14. The door handle assembly according to claim 1, wherein a bonding agent is provided for maintaining the threaded engagement of each threaded rod and the respective one of the at least one second posts.

15. A door assembly, comprising:

a door panel;

a first handle disposed on a first side of the door panel;

a second handle disposed on a second side of the door panel;

at least one first post, each of the at least one first posts including a first internally threaded bore;

at least one second post, each of the at least one second posts corresponding to a respective one of the at least one first posts, each of the at least one second posts including a second internally threaded bore; and at least one externally threaded rod, each of the externally threaded rods corresponding to and threadably engageable with a respective one of the at least one first posts and a respective one of the at least one second posts, the door panel including at least one bore for receiving a respective one of at least one externally threaded rods therethrough;

wherein for each corresponding pair of first posts and second posts, the first post is secured to one of the first handle and the second handle and rotatable relative to the one of the first handle and the second handle, and the second post is secured to the other of the first handle and the second handle and non-rotatable relative to the other one of the first handle and the second handle.

16. The door assembly according to claim 15, wherein each of the at least one first posts is substantially cylindrical.

17. The door assembly according to claim 15, wherein each of the at least one second posts is substantially cylindrical.

18. The door assembly according to claim 15, wherein the first handle includes at least one first channel for receiving a respective one of the posts.

19. The door assembly according to claim 15, wherein the second handle includes at least one second channel for receiving a respective one of the posts.

20. The door assembly according to claim 15, wherein the threaded rod is formed of a resilient material.

21. The door assembly according to claim 15, wherein the threaded rod is formed of nylon.

22. The door assembly according to claim 15, further comprising at least one bushing disposed between a surface of the first side of the door panel and a respective one of the at least one first posts.

23. The door assembly according to claim 15, further comprising at least one bushing disposed between a surface of the second side of the door panel and a respective one of the at least one second posts.

24. The door assembly according to claim 15, wherein each of the at least one second posts is secured to the respective handle by a set screw.

25. The door assembly according to claim 15, wherein each of the at least one first posts is secured to the respective handle by a set screw.

26. The door assembly according to claim 25, wherein the set screw includes a head portion and step portion, the step portion having a diameter less than a diameter of the head portion and having a height, each of the at least one first posts having a flange portion, the flange portion having a thickness less than the height of the step portion and having a bore for receiving the set screw therethrough, the bore having a diameter greater than the diameter of the step portion and less than the diameter of the head portion.

27. The door assembly according to claim 26, wherein the step portion is defined by a spacer.

28. The door assembly according to claim 15, wherein a bonding agent is provided for maintaining the threaded engagement between each threaded rod and the respective one of the at least one first posts.

29. The door assembly according to claim 15, wherein a bonding agent is provided for maintaining the threaded engagement between each threaded rod and the respective one of the at least one second posts.

* * * * *